US005238535A

United States Patent [19]

Kraft

[11] Patent Number: 5,238,535

[45] Date of Patent: Aug. 24, 1993

[54] WEB PICK-UP DEVICE AND METHOD FOR TRANSFER OF A PAPER WEB

[75] Inventor: Wilfried Kraft, Heidenheim, Fed. Rep. of Germany

[73] Assignee: J. M. Voith GmbH, Heidenheim, Fed. Rep. of Germany

[21] Appl. No.: 884,733

[22] Filed: May 15, 1992

[30] Foreign Application Priority Data

May 17, 1991 [DE] Fed. Rep. of Germany ..... 4116222

[51] Int. Cl.[5] ..... D21F 3/00

[52] U.S. Cl. ..... 162/193; 34/117; 34/120; 162/205; 162/358.1; 162/306; 162/359.1

[58] Field of Search ..... 162/193, 194, 286, 306, 162/359.1, 358.1, 363, 205; 34/117, 120

[56] References Cited

U.S. PATENT DOCUMENTS

| | | | |
|---|---|---|---|
| 2,780,968 | 2/1957 | Heys | 162/358.1 |
| 3,671,389 | 6/1972 | Wahlstrom et al. | 162/306 |
| 4,016,032 | 4/1977 | Kankaanpaa | 162/305 |
| 4,677,763 | 7/1987 | Kotitschke et al. | 34/123 |
| 4,769,111 | 9/1988 | Nevalainen et al. | 162/352 |
| 4,936,942 | 6/1990 | Sollinger et al. | 162/193 |
| 5,167,770 | 12/1992 | Bubik et al. | 162/352 |

FOREIGN PATENT DOCUMENTS

| | | |
|---|---|---|
| 0276202 | 7/1988 | European Pat. Off. . |
| 0344088 | 11/1989 | European Pat. Off. . |
| 0364114 | 4/1990 | European Pat. Off. . |
| 372429 | 2/1983 | Fed. Rep. of Germany . |

*Primary Examiner*—Karen M. Hastings
*Attorney, Agent, or Firm*—Baker & Daniels

[57] ABSTRACT

In a web pick-up device and a method of using the pick-up device in the press section of a paper machine, the running web makes contact, in a press gap, with a smooth rotating surface from which the web runs off at a point of pickup (A). The rotating surface and a suction box form together, in the area of the pickup point (A), a gap through which runs a porous conveyer belt which receives the fibrous web. The suction box is pivotably mounted and has in the area of the point of pickup (A) a sliding surface across which slides the conveyer belt, and which during operation is arranged at an adjustable spacing from the smooth surface. The spacing is determined by a stop on which bears the suction box during operation, under the effect of a flexible lift device.

19 Claims, 1 Drawing Sheet

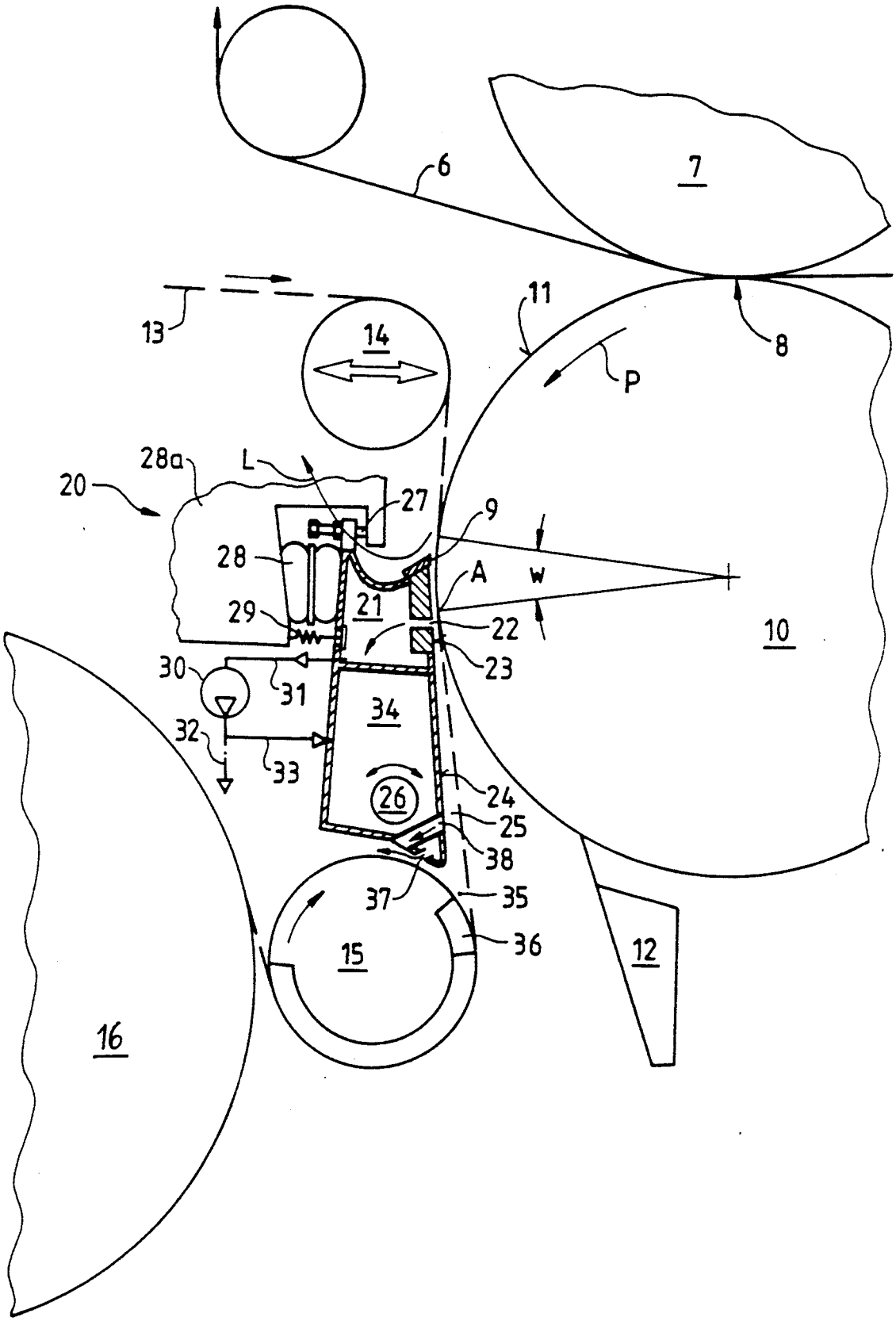
6
7
13
14
11
8
P
28a
L
20
27
9
28
A
W
29
21
22
10
30
23
31
34
32
33
26
24
25
38
37
35
36
15
12
16

WEB PICK-UP DEVICE AND METHOD FOR TRANSFER OF A PAPER WEB

BACKGROUND OF THE INVENTION

The invention is directed to a web pick-up device and method of using the device in the press section of a machine for making fibrous webs of paper, cardboard or the like. Web pick-up devices in the press section of a machine for making fibrous webs are known in the art. Running webs make contact in the press nip with a smooth rotating surface from which the web runs off at the point of pickup. The rotating surface and a suction box form together, in the area of the pick-up point, a gap through which runs a porous conveyor belt which receives the fibrous web.

Web pick-up devices of this general type are known, for example, in the following publications:

1U.S. Pat. No 4,016,032

2. Ep-A- 0364114,

3. EP-A- 0344088 (U.S. Pat No. 4,943,351)

4. Ep-A- 0276202.

Similar devices are known from:

5. AT-PS 372,429

6. U.S. Pat. No. 2,780,968.

On the devices known from publications 1 and 2, a suction roll is arranged on a press roll which features a smooth roll shell that makes direct contact with the fibrous web. A porous conveyer belt, preferably a so-called dry wire, runs across this suction roll. The press roll and the suction roll form together a gap through which passes the conveyer belt. The objective with this arrangement is to have the porous conveyer belt (by means of the suction prevailing on the suction roll) pick up the fibrous web from the press roll and transfer it to the subsequent drying section. This is achieved so that the pickup of the web from the smooth press roll occurs in a way such that the web will constantly be supported by some means of transport, namely first by the shell of the press roll and thereafter by the conveyer belt.

This is to avoid the presence of a free web train between the press shell and the conveyer belt. As is generally known, such a free web train causes an undesirable longitudinal stretch in the fibrous web, which at this point is still moist and possesses only little tensile strength. It must also be taken into account here that the still moist fibrous web clings at a relatively high adhesive force to the smooth shell of the press roll. By selecting a suitable shell material (for instance granite, artificial stone or plastic) it is attempted to reduce the adhesive force. Nevertheless, the longitudinal stretch of the web at the point of pickup remains a problem. Due to this longitudinal stretch, it happens relatively frequently during the operation that the fibrous web breaks at the point of pickup or in the subsequent drying section, thereby interrupting the production.

It had been difficult to establish the use of the aforementioned devices (where an attempt is made to avoid a free web train) in practice because of other difficulties. One of these difficulties consists in the following: As known, modern paper machines are generally dimensioned for an extremely large web width (in the order of up to 10 m). Therefore, all of the rollers must have a correspondingly large length, for which reason they undergo, under their deadweight and the respective load, a more or less heavy sagging. In the case of the known web pick-up devices, the consequence of this is that it is practically impossible to produce an exactly uniform gap between the press roll and the suction roll, without forcing the suction roll on the press roll. But such contact pressure must be avoided because the web would otherwise be damaged by the porous conveyor belt It must be taken into account here that the porous conveyor belt (preferably a so-called dry wire, which subsequently carries the web from the point of pickup through part of the drying section) has a considerably coarser structure than the wet felts used in the press section, and that the conveyor belt (normally) must be made endless by means of a seam.

Further known web pick-up devices have been described in publication 3. According to FIG. 17, the fibrous web to be dewatered runs between a felt and a smooth surface of a press belt through the press gap. Behind the press gap, the press belt and the web run with the roll shell and the press roll up to a point of pickup where a conveyer belt (for éxample a dry wire) is tangent with the press roll shell and receives the web from the press belt. Behind the point of departure, the conveyer belt runs together with the web along a straight section to a roll situated inside the conveyer belt loop (guide roll or drying cylinder).

In other embodiments of the publication 3, the press belt runs together with the web from the press gap first across an additional support roll, on the circumference of which the point of pickup is provided; that is, the dry wire touches at the point of pickup the support roll, picking the web up at that point; in several embodiments again with the aid of a vacuum box which, for example, may be fashioned as a suction box. All of the devices known from publication 3 have the disadvantages that the mentioned press belt means not only additional expenditure, but may now and then also cause an interruption of the operation, namely when it needs to be replaced by a new press belt because of wear.

In the case of another known web pick-up device (publication 4), the fibrous web to be dewatered runs directly on the smooth surface of the press roll shell from the press gap to the point of pickup, where it is received again by a conveyer belt. For separating the web from the smooth surface of the press roll there is an electrical induction heater provided. Interacting with the magnetically conductive shell material of the press roll, this heating device is supposed to effect a noncontact heating of the roll shell, and specifically the fibrous web, in order to thereby reduce the adhesive force of the moist web on the press roll shell. However, such a device involves a high consumption of energy. Besides, as compared to a simple suction device, it would appear to be more difficult to establish a reliable and trouble-free continuous operation.

The problem underlying the invention is to provide a web pick-up device, wherein during continuous operation the pickup of the fibrous web from the smooth press roll and the advance of the web to the following drying section can take place with greater safety than heretofore, i.e., with a lessened risk of web breaks. At the same time, just as with the known arrangement, a free web section is to be avoided, so that in the region of the web pick-up device no longitudinal stretch of the fibrous web will occur, or at the most a very slight longitudinal stretch will occur.

SUMMARY OF THE INVENTION

This problem is solved by the features of the present invention. The present invention, in one form thereof, comprises a web pick-up device in a press section of a machine for making fibrous webs, wherein a running web makes contact in a press nip with a smooth rotating surface, and wherein the web departs said surface at a point of pickup. The rotating surface and a suction box form together a gap in the area of the point of pickup, through which gap runs a porous conveyer belt, which belt receives the fibrous web. The suction box is pivotably mounted, and has in the area of the point of pickup a sliding surface across which slides the conveyer belt. The sliding surface is arranged at an adjustable spacing from the smooth rotating surface during operation of the device. The spacing is determined by a stop on which the suction box bears during operation under the effect of a flexible lift device.

The invention is based on the insight that it is important to have the porous conveyer belt, in the area of the point of pickup, supported by a sliding surface which can be adjusted to a very small distance from the smooth surface (preferably the press roll itself). Provided on the suction box, this sliding surface—in which preferably a suction opening (for instance a suction slot) is arranged—should be arranged, e.g., at a distance between 3 and 10 mm from the smooth surface. The optimal spacing needs to be determined operationally, for which reason the suction box needs to be pivotable, so that the distance can be determined by an adjustable stop.

It is also important that the suction box is operationally not secured rigidly to this stop, but that it is forced only gently on this stop under the effect of a flexible lift device. Thus, the spacing between suction box and the smooth surface (for instance the press roll) may during the operation, if needed, be increased automatically, for instance if fiber material lumps (so-called blobs) or other contaminations proceed in the case of operational trouble together with the fibrous web across the press roll. This avoids damages to the smooth surface (for instance of the press roll shell) or to the conveyer belt or the sliding surface of the suction box during such an occurrence.

As with the known devices, the web is continuously in contact with some means of transport; namely, it makes contact with the conveyer belt already before being picked up from the press roll. Thus, a free web train is avoided. The running speed of the conveyer belt and the peripheral speed of the press roll will normally be adjusted to the same value by control of the respective drive facilities. In this case, the longitudinal stretch of the fibrous web at the point of pickup equals zero. But with the inventional arrangement it is also possible to run the conveyer belt slightly faster than the press roll. In this case, then, a longitudinal stretch of the fibrous web takes place intentionally, but it is considerably less pronounced than in the presence of an open web train.

A particular advantage of the inventional web pick-up device is constituted in that it enables with simple means a separation of the web directly from the smooth press roll shell. In other words: contrary to publication 3, an additional, outwardly smooth press belt is dispensable. Depending on circumstances, however, the presence of such a press belt may for specific reasons be desirable, for instance in order to obtain a relatively soft press nip. In this case, too, the inventional web pick-up device is applicable.

Another advantage is that the inventional device can nonproblematically interact with a conveyer belt which has been made continuous by means of a seam.

BRIEF DESCRIPTION OF THE DRAWINGS

The drawing shows schematically a web pick-up device at the last press of a paper machine.

DESCRIPTION OF THE PREFERRED EMBODIMENT

In the embodiment depicted by the drawing, a lower press roll 10 and a backing roll 7 form a press nip 8 through which passes the web to be dewatered, together with a felt 6. The web makes contact with the smooth surface 11 of the press roll 10. The latter, e.g., is a known stone roll made from natural granite or a roll with a plastic coating. The objective in both cases is to so fashion the smooth surface 11 of the press roll 10 that the as yet moist fibrous web will cling to the roll shell with as low an adhesive force as possible.

The direction of rotation of the press roll 10 is indicated by arrow P. Thus, the fibrous web runs in the drawing from top to bottom toward a point of pickup A. A scraper 12 is arranged in the lower area of the press roll 10 in the usual way.

A porous conveyer belt 13 runs shortly before the point of pickup A onto the press roll 10. The conveyer belt 13 is supported by a horizontally movable guide roll 14 located above the point of pickup A and, below the point the point of pickup A, by a suction guide roll 15. Thus, the conveyer belt 13 forms together with the press roll 10 a small wrap angle w, the size of which can be varied by shifting the guide roll 14 horizontally. The conveyer belt 13 receives the fibrous web at the point of pickup A and passes it across the suction guide roll 15 to at least one subsequent drying cylinder 16. Next, the conveyer belt 13 (forming an endless loop) returns to the guide roll 14.

At the point of pickup A and within the endless loop of the conveyer belt 13 there is a suction box arranged, which overall is referenced 20. At point of pickup A, press roll 10 and suction box 20 define a gap (not numbered) therebetween. It has in its upper area a suction chamber 21 with at least one suction slot 22 situated as close as possible to the point of pickup A. The suction slot is located in the area of a predominantly flat sliding surface 23, across which slides the conveyer belt 13.

Following the sliding surface 23 there is a guide surface 24 provided, which as well is predominantly flat and diverges from the running direction of the conveyer belt 13 at a small angle. This part of the suction box 20 has thus the effect of a so-called web stabilizer. In other words: a suction is generated during the operation in the wedge-shaped space 25 between the guide surface 24 and the conveyer belt 13, by the running conveyer belt 13. The higher the operating speed of the paper machine (which ranges between 500 and 2000 m/min), the greater the vacuum. The guide surface 24 extends up into the entrance gore 35 between the suction guide roll 15 and the belt 13.

Thus, between the point of pickup A and the suction guide roll 15 there is constantly a vacuum exerted on the fibrous web, which suction acts through the conveyer belt 13, causing the fibrous web to be sucked up to the conveyer belt. This section of run being at least predominantly straight, no eccentric force (at any rate no appreciable eccentric force) acts in this region on the fibrous web.

The suction box 20 pivots about a bearing 26. The bearing 26 is arranged in the lower area of the suction box, so that in the upper area a spacing ma be adjusted between the sliding surface 23 and the surface 11 of the press roll 10. For that purpose, an adjustable stop 27 is provided on both ends of the suction box 20, on which stop the suction box is forced by means of a pneumatic, and thus flexible lift device 28. The latter is supported by a stationary component 28*a* with which the stop 27 (which may be fashioned as a screw) also makes contact.

Additionally, a tension spring 29 may be provided which counteracts the lift device, reducing its contact force. Thus, the suction box 20 can escape easily in the event that a contamination approaches the point of pickup A along with the fibrous web. In this context, the sliding surface 23 may be provided, before the suction slot 22, with a (not illustrated) rounding. The air boundary layer carried along by the conveyer belt 13 is deflected upward (arrow L) by a scraper bar 9, made for instance of felt material, which is arranged on the top side of the suction box 20 (in the area of the wrap angle w).

Schematically illustrated, in addition, is a suction line 31 connected to the suction chamber 21, and a suction blower 30. The latter can pass the suctioned air into the open (line 32) or, via a pressure line 33, in a blowing chamber 34 attached to the suction box. This blowing chamber 34 forms the already mentioned guide surface 24 and, if required, a blowing slot 37 to further boost the vacuum in the space 25. The blowing direction of the slot 37 is opposite to the running direction of the suction guide roll 15 and enhances the vacuum present in the gore 35 by ejector effect.

Additionally, as known as such, channels 38 originating from the guide surface 24 may be provided which extend crosswise through the blowing chamber 34, whereby the vacuum prevailing in the space 25 can be increased.

The air discharging from the blowing slot 37 is suctioned off again by a presuction zone 36 of the suction guide roll 15. In other words: a safe sucking of the web onto the conveyer belt is provided for also at the point where the conveyer belt 13 approaches the suction guide roll 15.

In variation from the drawing, the suction slot 22 may also be omitted. In this case, the suction effect of the suction box is achieved solely through the interaction of the stripper bar 9 with the diverging guide surface 24.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A web pick-up device in a press section of a machine for making fibrous webs, wherein a running web makes contact in a press nip with a smooth rotating surface, and wherein the web runs off said surface at a point of pickup, the rotating surface and a suction box forming together a gap in the area of the point of pickup, through which gap runs a porous conveyor belt, which belt receives the fibrous web, the improvement comprising means for pivotably mounting said suction box, said suction box having in said area of the point of pickup a sliding surface across which slides the conveyer belt, means for adjusting said sliding surface at an adjustable spacing from the smooth rotating surface during operation of said device, means defining a stop, and a flexible lift device structured and arranged to gently force sad suction box on said stop, said spacing being determined by said stop on which the suction box bears during operation under the effect of said flexible lift device.

2. The web pick-up device of claim 1, wherein the smooth rotating surface comprises the shell of a press roll, which shell together with a backing roll forms the press nip.

3. The web pick-up device of claim 1, in which a guide surface is arranged behind the sliding surface in the direction of travel of the running web, wherein the guide surface diverges from the conveyor belt at a small angle in the direction of travel of the conveyor belt.

4. The web pick-up device of claim 3, wherein the guide surface is part of the suction box.

5. The web pick-up device of claim 1, further comprising a scraper bar on said suction box for stripping an air boundary layer arriving along with the conveyor belt, said scraper bar being situated before said sliding surface in the direction of web travel an slightly spaced from the conveyer belt.

6. The web pick-up device of claim 1, further comprising a first belt guide roll situated before the point of pickup in the direction of web travel, said first belt guide roll being movable for purposes of varying an angle of wrap of the conveyer belt on the press roll.

7. The web pick-up device of claim 6, further comprising a second belt guide roll, said second belt guide roll being situated after the suction box in the direction of web travel and carrying said conveyor belt together with said fibrous web to a subsequent treatment station.

8. The web pick-up device of claim 1, further comprising a second belt guide roll, said second belt guide roll being situated after the suction box in the direction of web travel and carrying said conveyor belt together with said fibrous web to a subsequent treatment station.

9. The web pick-up device of claim 3, further comprising a second belt guide roll, said second belt guide roll being situated after the suction box in the direction of web travel and carrying said conveyor belt together with said fibrous web to a subsequent treatment station.

10. The web pick-up device of claim 7, wherein said second belt guide roll is a suction roll.

11. The web pick-up device of claim 8, wherein said second belt guide roll is a suction roll.

12. The web pick-up device of claim 9, wherein said second belt guide roll is a suction roll.

13. The web pick-up device of claim 9, wherein said guide surface extends into an entrance gore situated between said second belt guide roll and said conveyor belt.

14. The web pick-up device of claim 13, wherein said suction box includes means for sucking air out of said entrance gore.

15. The web pick-up device of claim 14, wherein said means for sucking air includes an ejector blow nozzle.

16. The web pick-up device of claim 1, wherein said suction box includes a suction opening in the area of the sliding surface.

17. The web pick-up device of claim 9, wherein said suction box includes a suction opening in the area of the sliding surface.

18. A web pick-up device in a press section of a machine for making fibrous webs, wherein a running web makes contact in a press nip with a smooth rotating surface, and wherein the web runs off said surface at a point of pickup, the rotating surface and a suction box forming together a gap in the area of the point of pickup, through which gap runs a porous conveyer belt, which belt receives the fibrous web, the improvement comprising means for pivotably mounting said suction box, said suction box having in said area of the point of pickup a sliding surface across which slides the conveyer belt, said mounting means providing an adjustable spacing between said sliding surface and said smooth rotating surface dependent on the orientation of said mounting means, means defining a stop, and a flexible lift device structured and arranged to gently force said suction box on said stop, said spacing being determined by said stop on which the suction box bears during operation under the effect of said flexible lift device.

19. A method of transferring a fibrous web in a machine, comprising the steps of:

contacting the running fibrous web with a smooth rotating surface in a press nip and guiding the fibrous web and a porous conveyer belt through a gap formed by the rotating surface and a suction box at a point of pick up;

running the fibrous web off of the smooth rotating surface at the point of pickup and receiving the fibrous web on the porous conveyer belt running through the gap;

pivotably mounting the suction box, the suction box having a sliding surface in the area of the point of pickup across which slides the conveyer belt;

adjusting said sliding surface to provide an adjustable spacing from the smooth rotating surface during operation of the machine; and gently forcing the suction box against a stop with a flexible lift device, said adjustable spacing determined by said stop.

* * * * *